US007548233B1

(12) United States Patent
Lee et al.

(10) Patent No.: US 7,548,233 B1
(45) Date of Patent: Jun. 16, 2009

(54) METHOD AND SYSTEM FOR IMAGE SCALING OUTPUT TIMING CALCULATION AND REMAPPING

(75) Inventors: Chang-Hau Lee, Fremont, CA (US); Minghua Lin, Campbell, CA (US)

(73) Assignee: Kolorific, Inc., Milpitas, CA (US)

( * ) Notice: Subject to any disclaimer, the term of this patent is extended or adjusted under 35 U.S.C. 154(b) by 932 days.

(21) Appl. No.: 10/938,303

(22) Filed: Sep. 10, 2004

(51) Int. Cl.
*G09G 5/00* (2006.01)

(52) U.S. Cl. ..... 345/204; 345/698

(58) Field of Classification Search ..... 345/698, 345/204, 1, 3, 213
See application file for complete search history.

(56) References Cited

U.S. PATENT DOCUMENTS 5,739,867 A * 4/1998 Eglit ..... 348/581
5,742,274 A * 4/1998 Henry et al. ..... 345/698
5,760,784 A * 6/1998 Bullis et al. ..... 345/660
6,177,922 B1 * 1/2001 Schiefer et al. ..... 345/698
6,181,300 B1 * 1/2001 Poon et al. ..... 345/698
6,329,981 B1 * 12/2001 Lin et al. ..... 345/204
6,563,484 B1 * 5/2003 Song ..... 345/98
2002/0018054 A1 * 2/2002 Tojima et al. ..... 345/204
2003/0184532 A1 * 10/2003 Chen et al. ..... 345/204
2004/0012578 A1 * 1/2004 Naegle ..... 345/204

* cited by examiner

*Primary Examiner*—Amare Mengistu
*Assistant Examiner*—Hong Zhou
(74) *Attorney, Agent, or Firm*—Pinnacle Patent Law Group

(57) ABSTRACT

A method and system for scaling video images between differently formatted display devices. The image scaling scheme of the present invention provides a method of receiving video signals of a first format, scaling the video signal to a second format by remapping pixels included in the first format to the second format by time delaying the input clock signal provided with the input video signal so that short or long line that typically accompany such signals are avoided.

21 Claims, 9 Drawing Sheets

METHOD AND SYSTEM FOR IMAGE SCALING OUTPUT TIMING CALCULATION AND REMAPPING

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

The invention pertains to image analysis, more specifically to a method and a system for image scaling output timing calculation.

2. Description of Related Art

Digital image data generally defines one or more frames. A frame is an image displayed for viewing on a display screen or panel at one time. Each frame includes a rectangular array of pixels. Each pixel has one or more values, for example a gray scale value for a monochrome display or RGB values for a color display. In order to run the many individual multimedia products on the market, computer systems are required to display many different programs that generate different types of images at different times. Conventional computer systems may use a graphics system to generate graphics and video pixel data for display on a display device. The pixel data is passed to the display device and produces the images viewed on the display device. With the emergence of new display technologies, the transition from one display resolution on a particular display format to another presents a host of problems when the same application is run on two different computer systems with varying display resolutions. Common display resolution include those shown in Table 1 indicating the number of pixels in each dimension.

TABLE 1

| | | |
|---|---|---|
| VGA | 640 | 480 |
| SVGA | 800 | 600 |
| XGA | 1024 | 768 |
| SXGA | 1280 | 1024 |
| UXGA | 1600 | 1200 |
| HDTV | 1280 | 720 |

Where the resolution or sample rate of the display device matches the resolution of a particular image data being displayed, the image data can be displayed directly; or if not, the image data may have to be scaled or formatted to the appropriate format acceptable to the particular display device. Scaling can be done in either vertical or horizontal or both dimensions and the sample rates can be scaled up or down. Scaling becomes particularly important in the case of pixelated display systems in display devices such as liquid crystal displays (LCDs), projectors, flat panel displays, PDP, FED, EL, DMD, etc., that have a pixel structure.

Image scaling is typically accomplished using sample rate conversion where the sample rate converters scales by a rational number UM where L and M are positive integers. U.S. Pat. Nos. 4,020,332, 4,682,301, and 6,339,434 all disclose image scaling using integer conversion rates.

However, in each of these disclosures, performing image scaling from one display format to another and keeping the same frame rate to render the last line of each output frame from being either a short line or a long line that some display panels cannot tolerate. Accordingly, a need remains for improvements in image scaling schemes to eliminate short lines or long lines. Particularly, a need exists for a system that improves the performance of image scaling between display devices at lower costs and higher performance.

BRIEF SUMMARY OF THE INVENTION

The present invention overcomes the inadequacies and deficiencies of the prior art as discussed hereinabove. The present invention provides a method for measuring input and output timings to eliminate the rendering of short lines or longs during image conversions between display devices or varying formats. According to the present invention, a method and system are provided whereby the image scaling between display device of varying formats is described.

An aspect of the present invention includes a method and a system of providing an image output timing where that accumulates the total output time to display a particular image in order to match the total input time of the originating image in order to prevent common image splicing.

According to another aspect of the present invention, a method and system are also provided for an image display output remapping scheme that remaps the output timing sequence to the incoming input video signal timing sequence in order to be able to display a complete image within an allotted rendering frame rate. The remapping logic also calculates how many lines should be remapped extra pixels and which lines are to be remapped.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus and methods generally shown in FIG. 1 through FIG. 9. It will be appreciated that the apparatus may vary as to configuration and as to details of the parts, and that the method may vary as to the specific steps and sequence, without departing from the basic concepts as disclosed herein.

Many well-known elements (e.g., memory, data busses, interfaces) have been omitted from the accompanying drawings so as to more clearly show embodiments of the invention. Like-numbered elements shown in the various drawings represent like elements.

Figure 1:
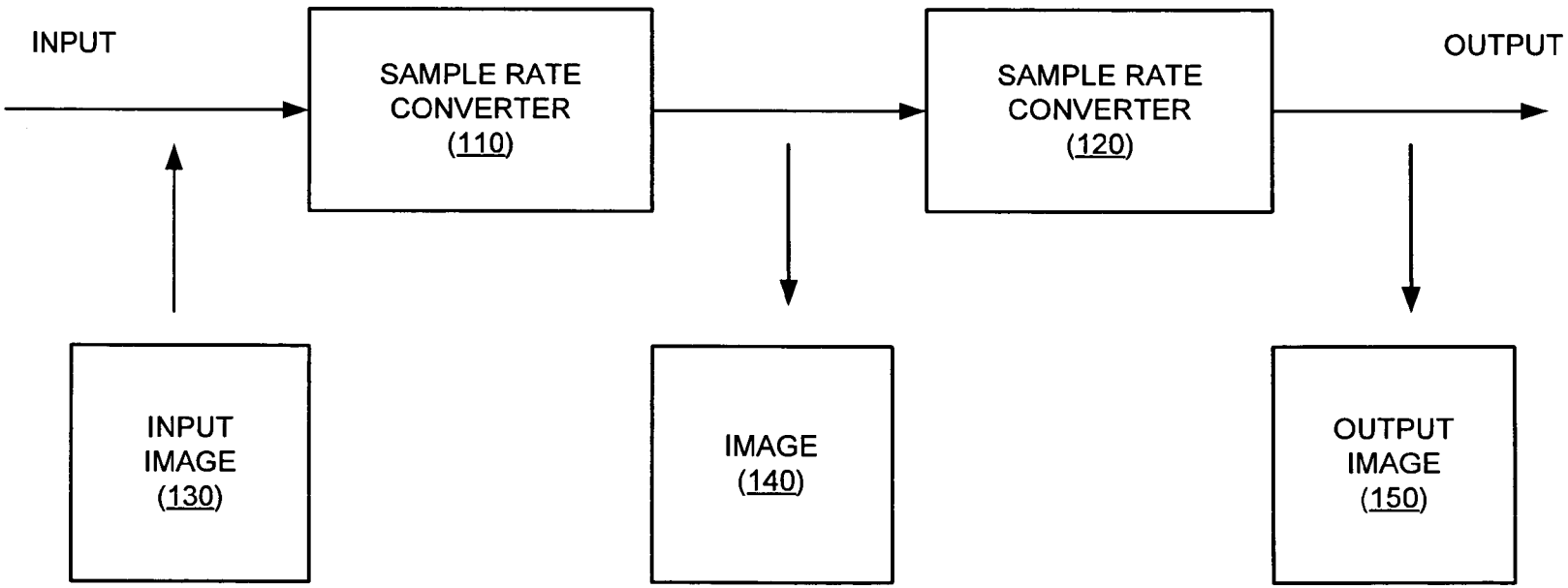
FIG. 1 (PRIOR ART)
FIG. 1 is a block diagram of a prior art image scaling using a sample rate converter.

FIG. 1 is a prior art example of a circuit for changing the size of an image using two image scaling circuits or sample rate converters, one for each dimension. Sample rate converter 110 enlarges or reduces the image 130 by a factor of Ly/My in the vertical dimension, producing image 140. Sample rate converter 120 performs the same function in the horizontal dimension, enlarging or reducing image 140 by a factor of Lx/Mx in the horizontal direction producing, in turn, image 150. In the prior art illustrated in FIG. 1, the scale factors Ly, My, Lx, Mx are integers which allows image scaling either upwards or downwards only in integers.

Figure 2:
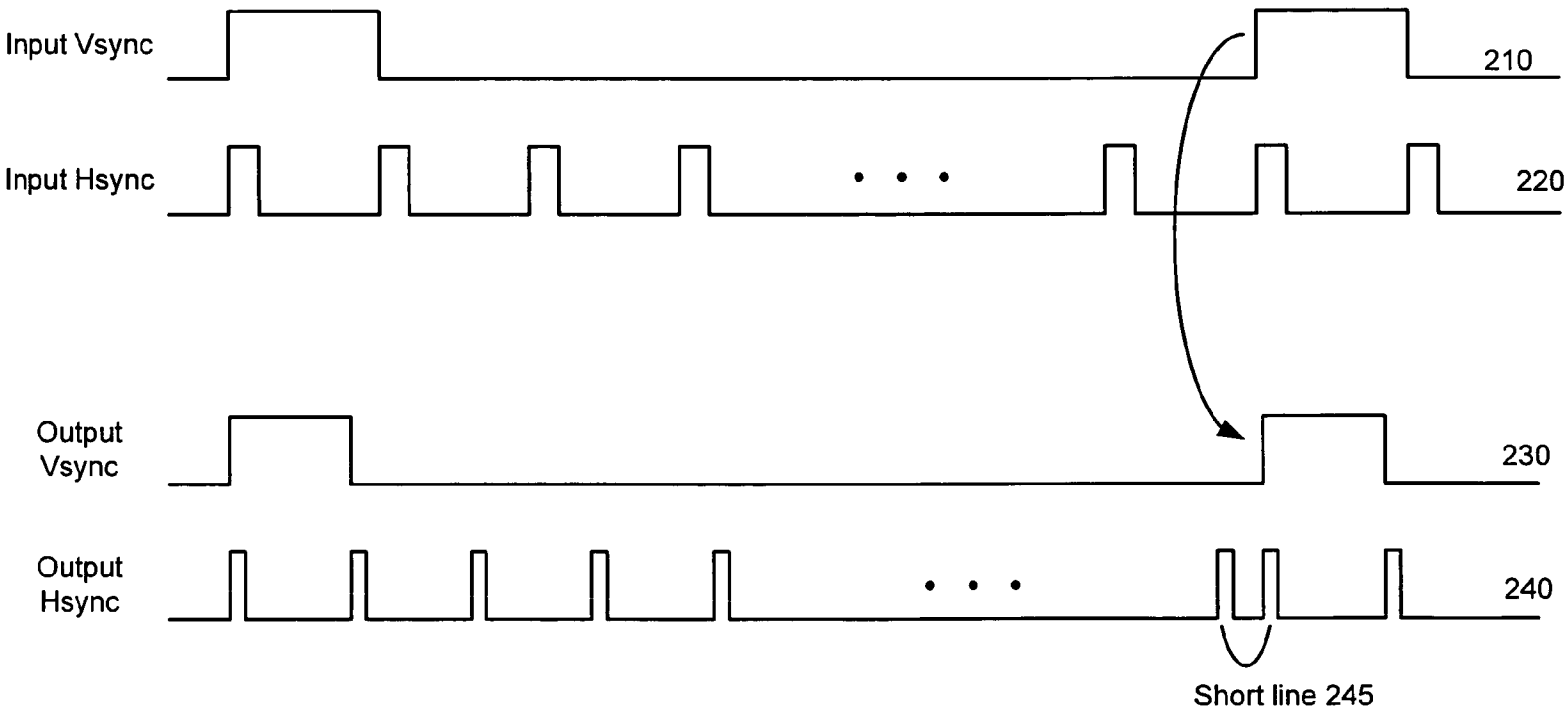
FIG. 2 is a simplified timing waveform of a prior art image scaling scheme of short lines in a signal input.
Figure 3:
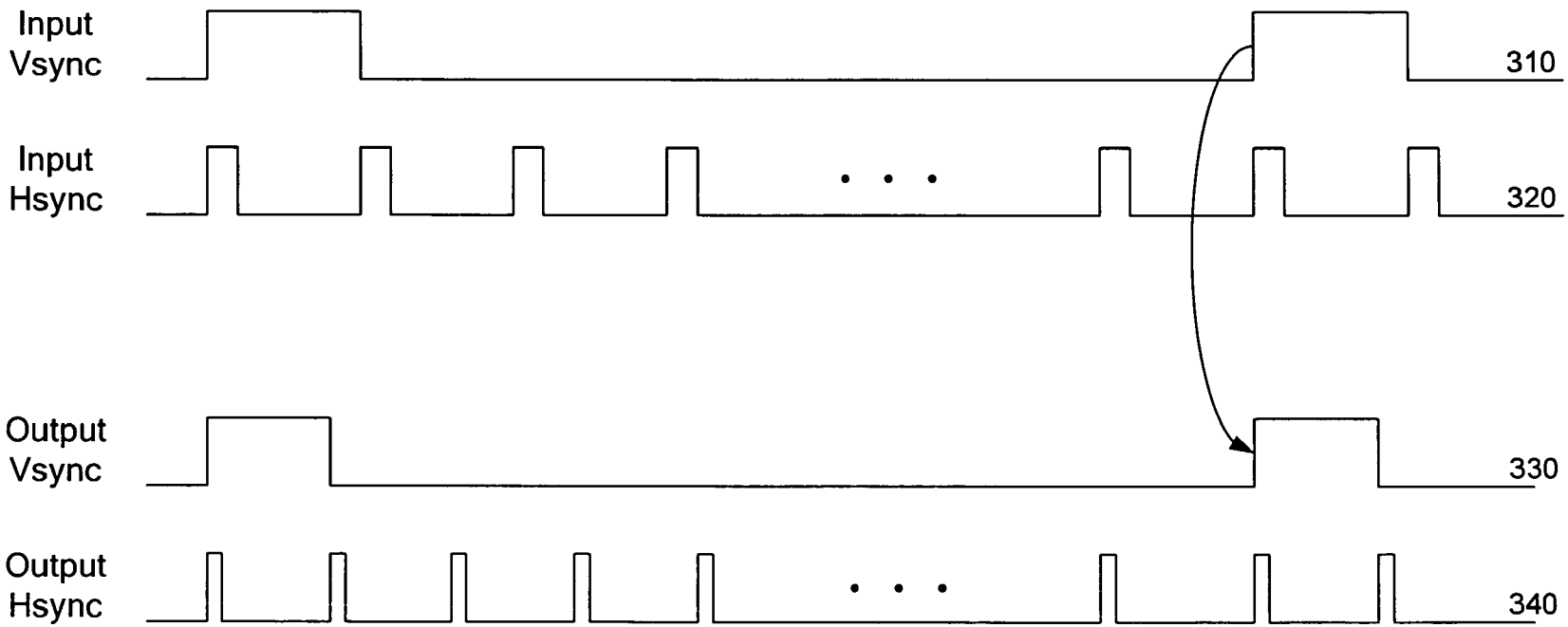
FIG. 3 is a simplified timing waveform of a prior art image scaling scheme of long lines in a signal input.

FIG. 2 is a simplified prior art waveform illustrating the scaling of an image with a short line. In the example shown in FIG. 2, the output Vsync 230 is generated by a display phase lock loop based on an external clock and is reset by the input Vsync 210. Thus, a short line 245 results thereby distorting the output Hsync signal 240. Similarly in FIG. 3, a long line results by the incompatible timing signals of the output Vsync 340 and the input Vsync 320. Having a short line as shown in FIG. 2 and the long lines in FIG. 3 results in the display panel incapable of tolerating these lines thereby distorting the output display image.

Figure 4:
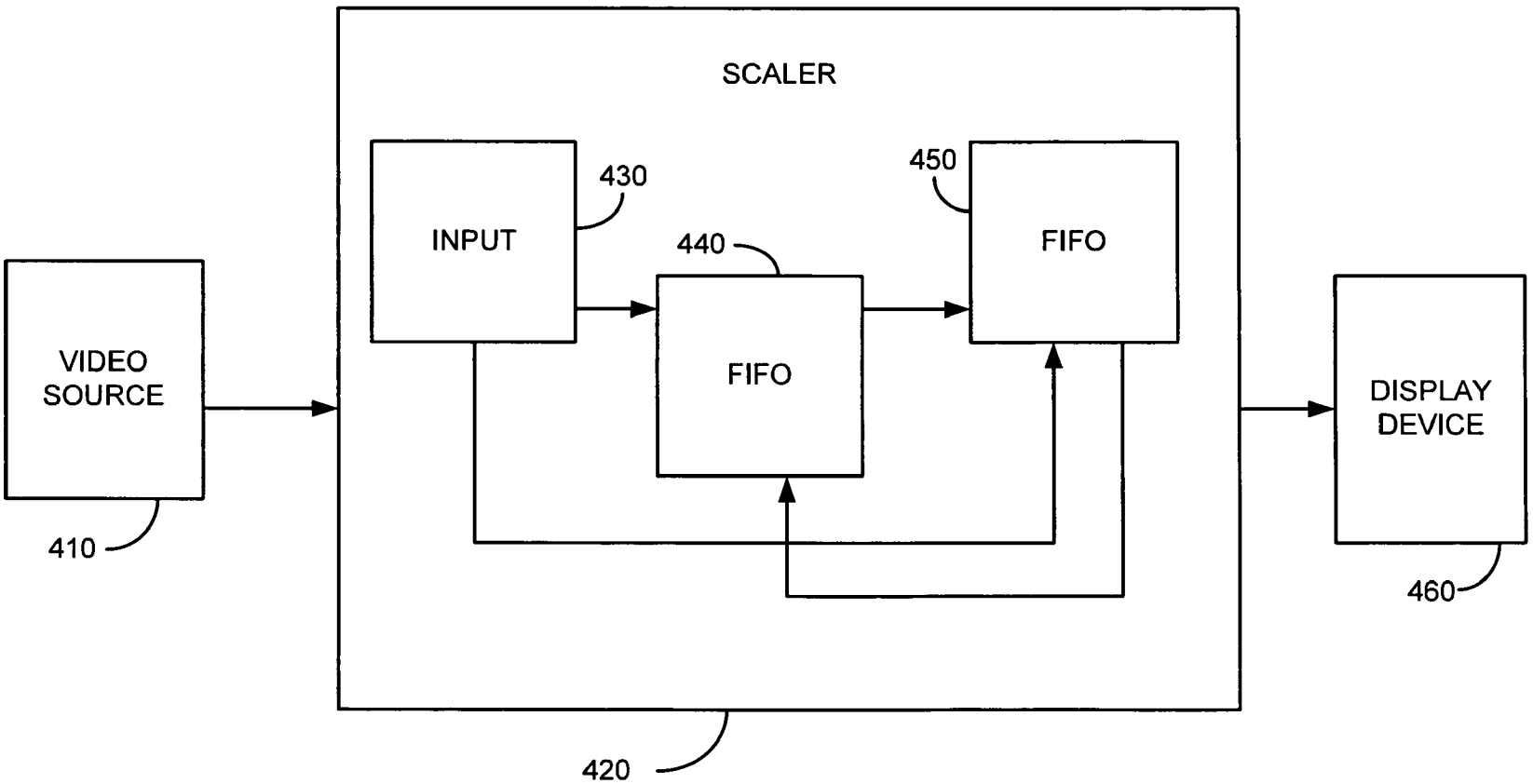
FIG. 4 is a simplified block diagram illustrating one embodiment of image scaling according to the present invention.

FIG. 4 is a simplified block diagram illustration of one embodiment of the image scaling system 400 of the present invention. As shown in FIG. 4, video signals comprising video source data are transmitted from a video source to a image scaler 420 to be scaled to an appropriate format in the display device 460. In one embodiment, the video signals for the video source 410 may be presented to the image scaler 420 to be either up-scaled or down-scaled to the appropriate format to the corresponding display panel.

The image scaler 420, in one embodiment, receives the input video signals and determines the scaling parameters to use to display to the target display device 460. In one embodiment, the image scaler 420 comprises input video buffer unit 430, scaling logic unit 440 and output time generator 450.

In one embodiment, the image scaler 420 while performing image scaling to resize a received video input signal to a fixed resolution display panel locks the output total time to display the image to the total input time of the signal received in order to maintain the same frame rate. The total output time is also locked to correspond to the total input time to keep the internal line buffers of the image scaler 420 from being either over-run or under-run.

In one embodiment, a state machine (not shown) generates an output timing signal that is reset by the incoming input vertical synchronization (Vsync) of the input video signal. The output timing signal is also set so that the corresponding output image to the display device is void of any short lines or long lines distortions. As shown in FIG. 4, the image scaler 420 also includes a timing generator 450 for generating the output horizontal synchronization signals (Hsync) and the output vertical synchronization signals (Vsync) corresponding to the incoming video signals.

Figure 5:
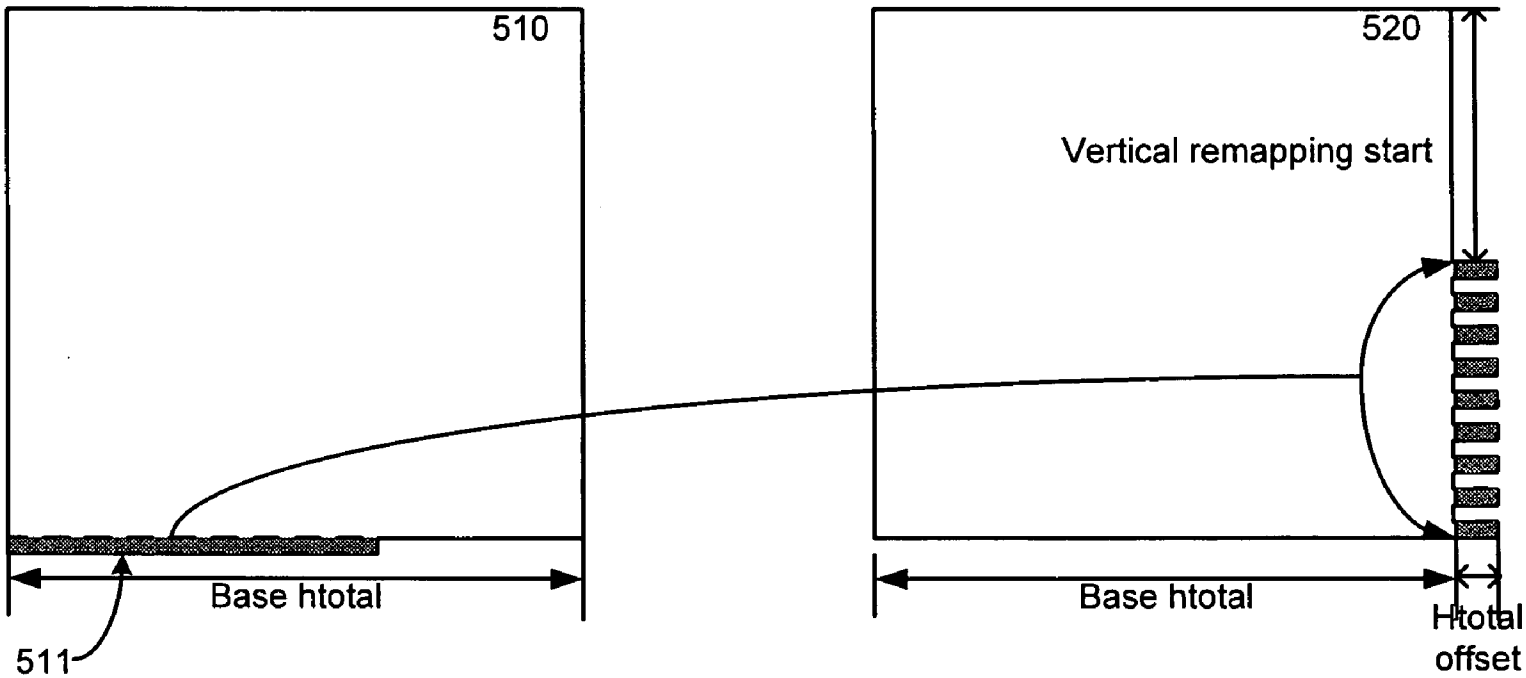
FIG. 5 is a simplified block diagram illustration of one embodiment of image remapping according to the present invention.

FIG. 5 is a simplified block diagram illustrating one embodiment of the image scaling scheme of the present invention. As shown in FIG. 5, the last line of an output timing without remapping 510 is remapped into the image scaler 420 of the present invention by mapping the last short line 511 to offset positions in image 520. In 510, the last line in a particular signal 511 is a short line. The image scaler 420 calculates the number of pixels to determine where to start a remapping operation for the incoming signal 510.

For example, if the total pixel count is X, then the remapping operation may start at the position where Vtotal is equal to Y. In the example illustrated in FIG. 5, a base horizontal total in 510 is assigned to the horizontal total value of the output display pixel. A start point in 520 in the vertical direction is checked to determine whether it is the designated starting point to remap short line pixels in 511. The image scaler 420 then calculates the starting point to initiate a remap by adding a horizontal total offset value to remap the data. In one embodiment of the present invention, the horizontal offset value is an even number because display devices generally are dual channel.

Figure 6:
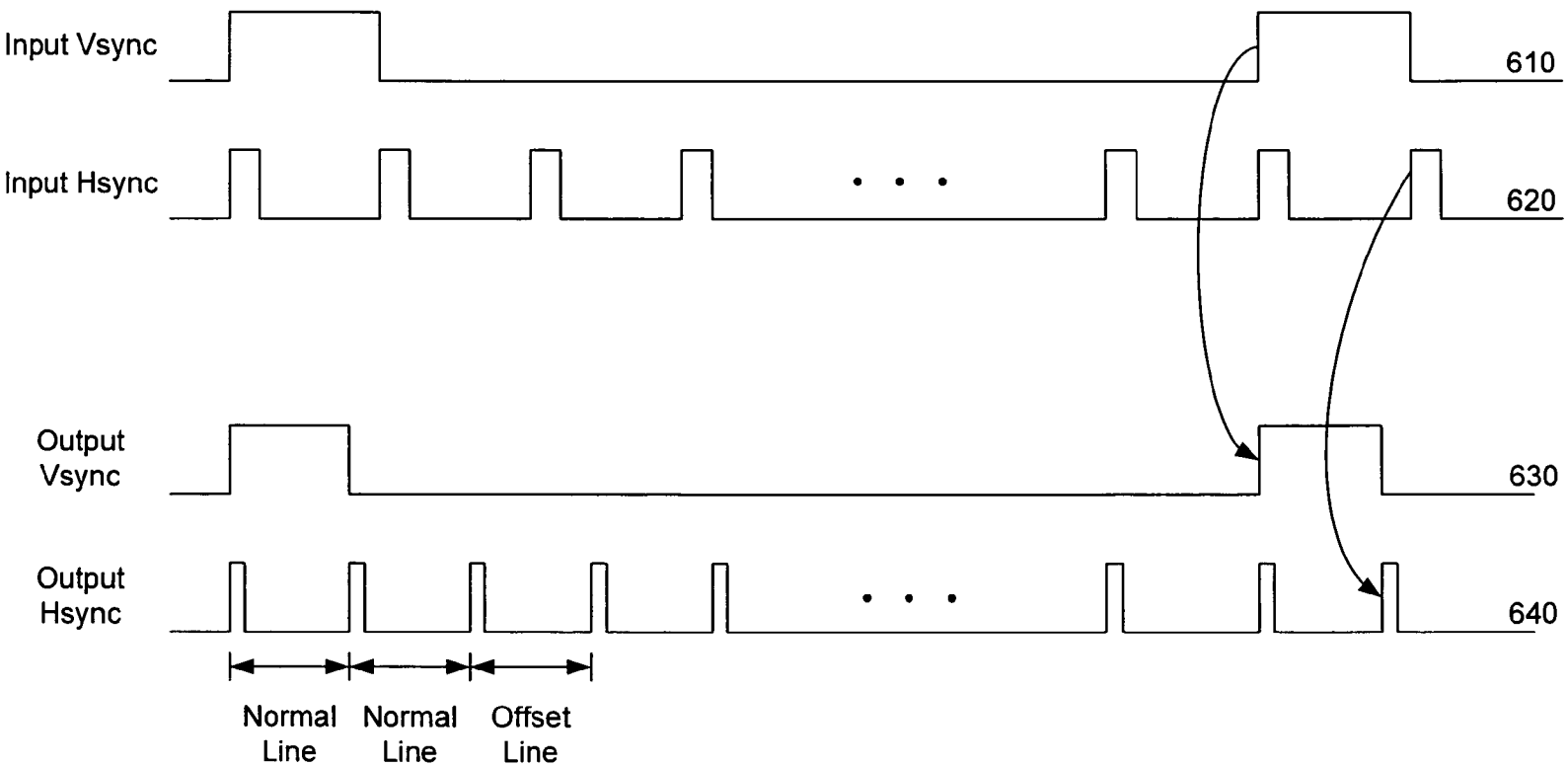
FIG. 6 is a simplified timing waveform according to an embodiment of the present invention.

FIG. 6 is an exemplary waveform diagram illustrating a video signal data scaling in one embodiment of the present invention. As shown FIG. 6, the input Vsync signal 610 and the output Vsync signal 630 are synchronized by the present invention to prevent the appearance of short lines and long lines.

Figure 7:
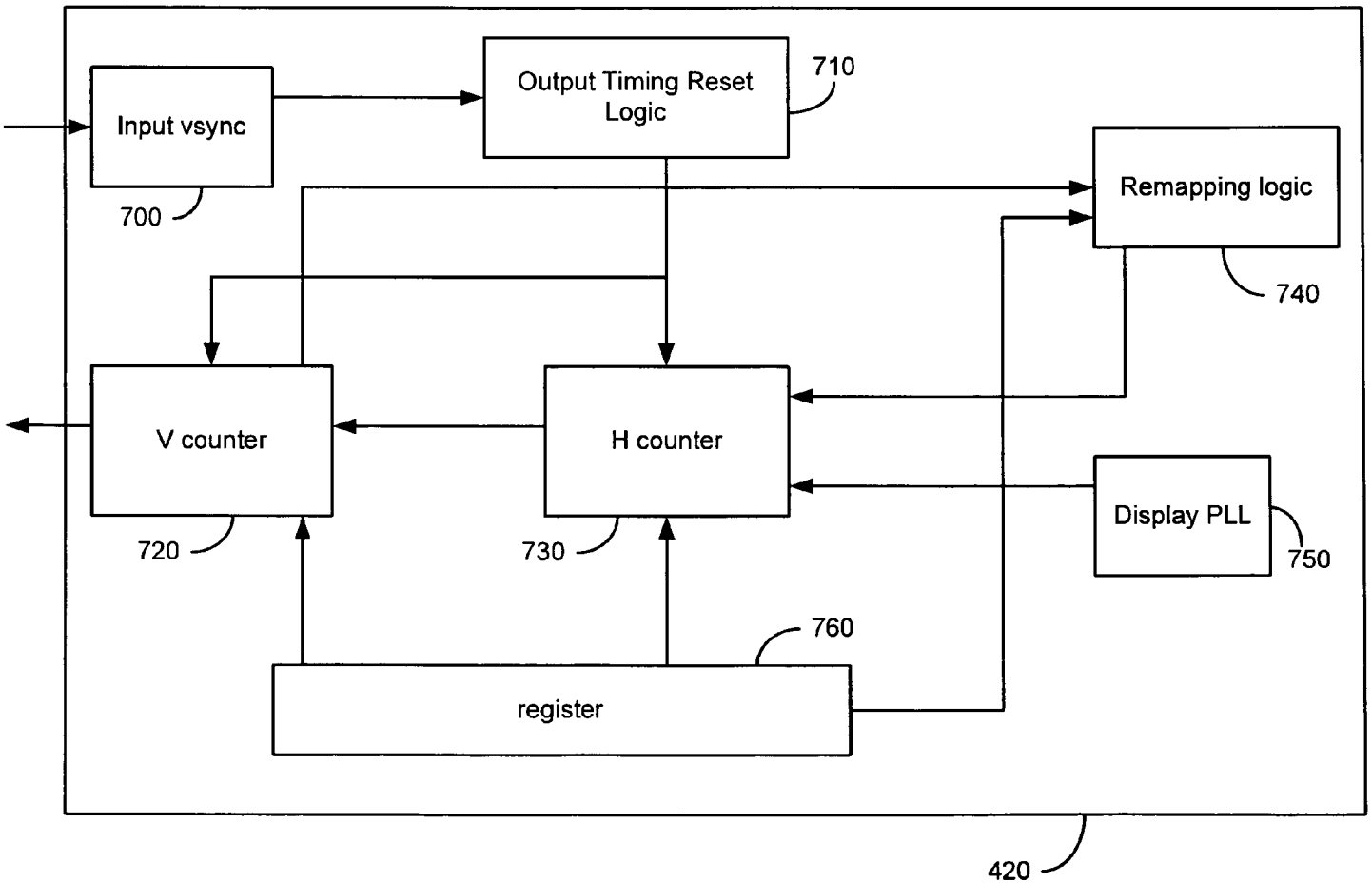
FIG. 7 is a block diagram of one embodiment of the internal architecture of the image scaler of the present invention.

FIG. 7 is a simplified block diagram illustration of one embodiment of the internal architecture of the image scaling circuit 420 of the present invention. As shown in FIG. 7, the image scaling circuit 420 comprises video input synchronization unit 700, output timing reset logic unit 710, vertical line counter 720, horizontal pixel counter 730, remapping logic unit 740, display phase lock loop unit 750 and registers 760.

In one embodiment, the video input synchronization unit 700 receives input video signals designated for scaling and synchronizes the input signals with the output clock signal of the scaling circuit 420. The synchronization signals are then presented to the output timing reset logic unit 710 to generate reset signals for the horizontal pixel counter 730 and the vertical line counter 720 when the input vertical synchronization (vsync) signal is in the rising edge of the input clock.

In one embodiment, the horizontal pixel counter 730 includes counters, adders and comparators to count the number of horizontal lines presented by the output timing reset logic unit 710. The counter output of the horizontal pixel counter 730 is increased by one on every output clock rising edge. The adder(s) in the horizontal pixel counter 730 is the sum of the horizontal pixel total (Htotal) and the horizontal pixel offset (Hoffset).

The comparator(s) of the Hcounter 730 generates an output Hsync signal that is equal to one when the combined horizontal pixel offset from 740 additions from the Htotal from 760 is equal to the horizontal pixel count 730. In one embodiment, the horizontal pixel count total (Htotal) is the programmed number of the number of pixels per line.

Still referring to FIG. 7, the Vcounter 720 includes counters and comparator logic for counting the vertical lines in a given input video signal. In one embodiment, the counter output (Vcount) is increased by 1 on every horizontal synchronization (Hsync) rising edge. The comparator generates a "vysnc=1" when the "Vcount" is equal to the "Vtotal" and input Vsync where "Vtotal" is the programmed number of lines per a given frame.

The Vcount is presented to the remapping logic unit 740 which calculates how many lines should be remapped for extra pixels. Registers 760 present to the remapping logic 740 how many extra pixels will be added into the lines which are decided to be remapped. The remapping logic 740 presents to the Hcounter 730 the "Hoffset" signals for each line. Hcounter 730 then is able to reset and assert Hsync signal if it counts to output Htotal+Hoffset. Effectively, the remapping logic 740 delays the output clock in order to transmit any extra pixels during a single output clock cycle.

In one embodiment of the invention, the remapping logic 740 uses the following equation to remap extra pixels in the image scaled:

Number of extra pixels ($X$)=((input $H$total*input $V$total*input clock cycle time)−(output $H$total*output $V$total*output clock cycle time))/output clock cycle time.

Number of lines allowed for remap ($Y$)=output $V$total−vertical remap start

Where the vertical remap start is a programmed value which means when to start a remap.

Remap Step S=X/O/Y; Offset quantity O is a programmed number of the number of extra pixels added in each remapped line.

where remap step S should be a number between 0 and 1. In here, a logic being used when hsync rising edge:

Sum=Sum+$S$

If(Sum>=1), {H offset=0, Sum=Sum−1} else {H offset=zero, Sum=Sum}.

An exemplary image scaling of one embodiment of the present invention using the above defined equation is as follows:

If Input H total=35; input V total=20; input clock cycle time=10;

output H total=48; output V total=29; output clock cycle time=5;

Vertical remap start=9; offset quantity O=2; then $X$=(35*20*10−48*29*5) 5=8

$Y$=29 −9=20

$S$=$X$/$O$/$Y$=8/2/20=20

| Line number | Sum | H offset |
|---|---|---|
| 1 | 0 | 0 |
| 2 | 0 | 0 |
| . . . | | |
| 9 | 0 | 0 |
| 10 | 0.2 | 0 |
| 11 | 0.4 | 0 |
| 12 | 0.6 | 0 |
| 13 | 0.8 | 0 |
| 14 | 0 | 2 |
| 15 | 0.2 | 0 |
| . . . | | |
| 18 | 0.8 | 0 |
| 19 | 0 | 2 |
| . . . | 0 | 0 |

-continued

| Line number | Sum | H offset |
|---|---|---|
| 24 | 0 | 2 |
| . . . | | |
| 29 | 0 | 2 |

Figure 8:
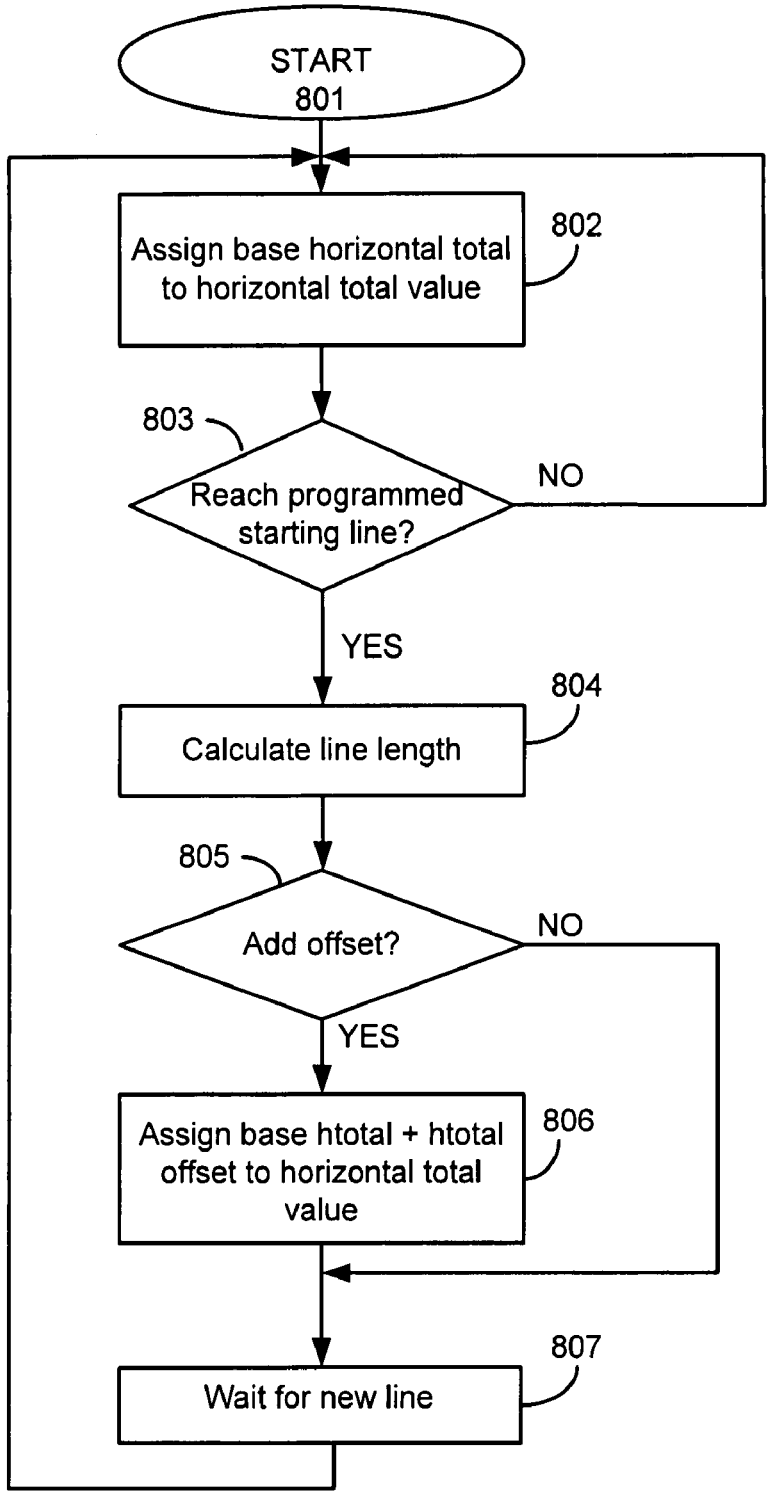
FIG. 8 is a flow diagram illustrating image scaling according to of one embodiment of the present invention.

FIG. 8 is flow diagram illustration of one embodiment of the image scaling scheme of the present invention. As shown in FIG. 8, an image scaling process commences 801 with the assignment of a base horizontal total to the horizontal total value at step 802. At step 803 the image scaling unit determines whether the vertical line counter has reached a programmed vertical starting line. If the vertical line counter has reached a programmed starting line, the horizontal line length is calculated at step 804; otherwise, the image scaling unit continues to monitor the vertical line counter.

At step 805, the image scaling unit determines whether to add a horizontal offset to the value of the line length. If the horizontal offset is added to the line length, the base horizontal total and the horizontal offset is assigned to the horizontal total value at step 806 and the image scaling unit waits for a new line at step 807.

Figure 9:
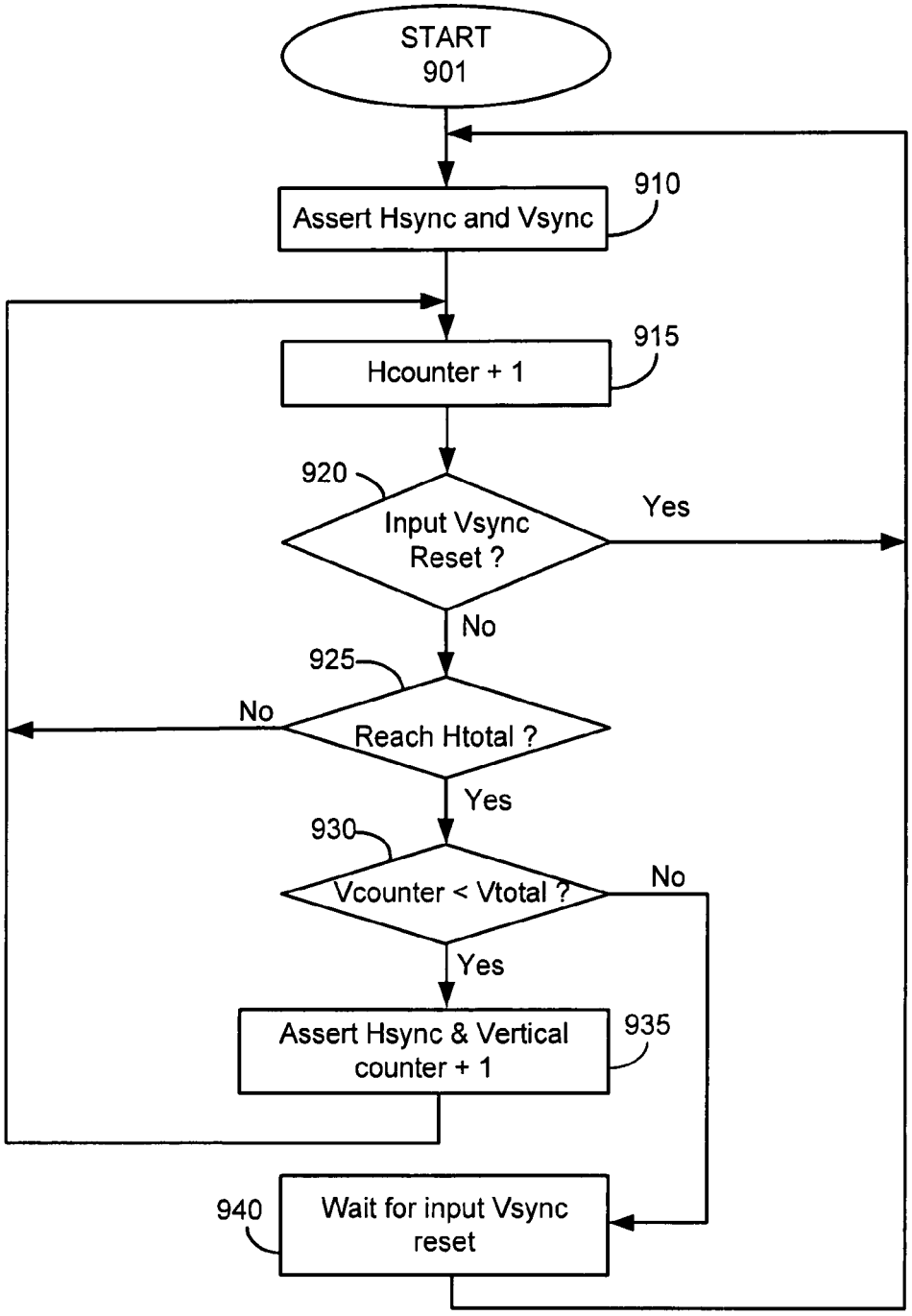
FIG. 9 is a flow diagram illustrating image scaling according to of another embodiment of the present invention.

FIG. 9 is flow diagram illustration of one embodiment of the image scaling scheme of the present invention. As shown in FIG. 9, the image scaling unit monitors the horizontal and vertical lines calculated at step 804 by asserting the hsync and vsync signals as each line is processed at step 910. At step 915, if the incoming signal is a horizontal line, the horizontal line counter is increased by 1. At step 920, the image scaling unit checks to see whether to reset the image scaling system.

At step 925, the image scaling unit determines whether the horizontal total has been reached. If the Htotal is reached, the image scaling system determines whether the vertical counter is less than the vertical total at step 930. On the other hand if the Htotal has not been reached, the Hcounter is increased by 1 at step 915. If the Vcounter is less than the Vtotal at step 930, the image scaling system asserts the Hsync and increase the Vcounter by 1. However, if the Vcounter is not less than the Vtotal, the image scaling system waits for input Vsync reset at step 940.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An image scaling system for scaling video signal data between different formatted display devices, said image scaling system comprising:

a video processing unit;

an image scaling unit;

a timing generator; and a remapping logic unit configured for:

calculating a number of extra pixels based on a parameter by:

calculating an expected number of input pixels based on a first format and calculating an expected number of output pixels based on a second format;

calculating an input frame rate by multiplying an input clock cycle time by the expected number of input pixels;

setting an output frame rate to the calculated input frame rate, wherein the output frame rate is a product of an output clock cycle time and a sum of the expected number of output pixels and the number of extra pixels; and calculating the number of extra pixels by dividing the input frame rate by the output clock cycle and subtracting the expected number of output pixels; and remapping at least one extra pixel to an offset position in at least one previous scan line, thereby eliminating the rendering of a short or a long scan line during image conversion between a first display device having the first format and a second display device having the second format.

2. The image scaling system of claim 1, wherein the image scaling unit comprises an input vertical synchronization (Vsync) signal unit for receiving vertical synchronization signals from an input video signal being scaled.

3. The image scaling system of claim 2, wherein the image scaling unit further comprises an output timing reset logic unit for generating reset signals for signal counters during a rising edge of the input vsync signal.

4. The image scaling system of claim 1, wherein the remapping logic unit is configured to determine the at least one previous scan line based on the calculated number of extra pixels to enable a scaled image to appropriately fit a designated display panel.

5. The image scaling system of claim 4, wherein the image scaling unit further comprises a vertical signal line counter for counting the number of vertical lines in each video signal scaled.

6. The image scaling system of claim 5, wherein the image scaling unit further comprises a horizontal signal pixel counter for counting the number horizontal pixels in each video signal scaled.

7. The image scaling system of claim 6, wherein the vertical signal line counter includes comparator logic for determining when a total vertical line count is equal to a vertical line count.

8. The image scaling system of claim 7, wherein the image scaling unit further comprises a display phase lock loop unit for generating output clock signals in a specified programmed frequency for each scaled line in the scaled image.

9. An image scaling circuit for scaling video data to a corresponding display panel format, the image scaling circuit comprising:

a signal input buffer unit for receiving an input stream of pixel data of a first size;

a signal output buffer unit for outputting a stream of pixel data of a second size; and a video data scaling unit for:

calculating a number of extra pixels based on a parameters by:

calculating an expected number of input pixels based on the first size and calculating an expected number of output pixels based on the second size;

calculating an input frame rate by multiplying an input clock cycle time by the expected number of input pixels;

setting an output frame rate to the calculated input frame rate, wherein the output frame rate is a product of an output clock cycle time and a sum of the expected number of output pixels and the number of extra pixels; and calculating the number of extra pixels by dividing the input frame rate by the output clock cycle and subtracting the expected number of output pixels; and remapping at least one extra pixel to an offset position in at least one previous scan line, thereby eliminating the rendering of a short or a long scan line during image conversion between the pixel data of the first size to the pixel data of the second size to fit a designated format display panel.

10. The image scaling circuit of claim 9, wherein the pixel data of the second size is a scaled version of the pixel data of the first size.

11. The image scaling circuit of claim 10, wherein the video data scaling unit further remaps the pixel data of the first size to the pixel data of the second size to avoid long lines and short lines while generating the output video stream of pixel data.

12. The image scaling circuit of claim 11, wherein the video data scaling unit further synchronizes input timing signals of a received video signal to the output timing signals of corresponding scaled output video signals to prevent distorted images to the designated display panel.

13. The image scaling circuit of claim 9, wherein the video data scaling unit comprises an input vertical synchronization (Vsync) signal unit for receiving vertical synchronization signals from an input video signal being scaled.

14. The image scaling circuit of claim 13, wherein the video data scaling unit further comprises an output timing reset_logic unit for generating reset signals for signal counters during a rising edge of the input vsync signal.

15. The image scaling circuit of claim 9, wherein the video data scaling unit further comprises remapping logic for determining the at least one previous scan line based on the calculated number of extra pixels to enable a scaled image to appropriately fit a designated display panel.

16. The image scaling circuit of claim 15, wherein the video data scaling unit further comprises a vertical signal line counter for counting the number of vertical lines in each video signal scaled.

17. The image scaling circuit of claim 16, wherein the video data scaling unit further comprises a horizontal signal pixel counter for counting the number of horizontal pixels in each video signal scaled.

18. The image scaling circuit of claim 16, wherein the vertical signal line counter include comparator logic for determining when a total vertical line count is equal to a vertical line count.

19. The image scaling circuit of claim 18, wherein the video data image scaling unit further comprises a display phase lock loop unit for generating output clock signals in a specified programmed frequency for each scaled line in the scaled image.

20. An image scaling circuit for scaling video data to a corresponding display panel format, the image scaling circuit comprising:

a signal input buffer unit for receiving an input stream of pixel data of a first size;

a signal output buffer unit for outputting a stream of pixel data of a second size; and remapping logic for:

calculating a number of extra pixels based on a parameters by:

calculating an expected number of input pixels based on the first size and calculating an expected number of output pixels based on the second size;

calculating an input frame rate by multiplying an input clock cycle time by the expected number of input pixels;

setting an output frame rate to the calculated input frame rate, wherein the output frame rate is a product of an output clock cycle time and a sum of the expected number of output pixels and the number of extra pixels; and calculating the number of extra pixels by dividing the input frame rate by the output clock cycle and subtracting the expected number of output pixels; and remapping at least one extra pixel to an offset position in at least one previous scan line, thereby eliminating the rendering of a short or a long scan line during image conversion between the pixel data of the first size to the pixel data of the second size to fit a designated format display panel.

21. A method of scaling video signals from a first format display panel to a second display panel of a second format, the method comprising:

during an initialization process of the second display panel, calculating a number of extra pixels based on a parameters by:

calculating an expected number of input pixels based on a first format and calculating an expected number of output pixels based on a second format;

calculating an input frame rate by multiplying an input clock cycle time by the expected number of input pixels;

setting an output frame rate to the calculated input frame rate, wherein the output frame rate is a product of an output clock cycle time and a sum of the expected number of output pixels and the number of extra pixels; and calculating the number of extra pixels by dividing the input frame rate by the output clock cycle and subtracting the expected number of output pixels;

selecting a horizontal pixel offset value;

selecting a scan line in the frame of the second format having a base horizontal line length, wherein the selected scan line is a previous scan line to the last scan line;

determining whether to extend the base horizontal line length of the selected scan line by the horizontal pixel offset value based on the calculated number of extra pixels;

if the selected scan line is extended, remapping at least one extra pixel to at least one offset position in the extended scan line;

selecting a next scan line in the frame of the second format having the base horizontal line length; and repeating the determining, the remapping, and the next scan line selecting processes until the selected scan line is the last scan line, such that each extra pixel is remapped to an extended scan line.

* * * * *